US008646362B2

(12) United States Patent
Schildmeier

(10) Patent No.: US 8,646,362 B2
(45) Date of Patent: Feb. 11, 2014

(54) SPECIAL FLUORESCENT BULB HOLDING DEVICE

(76) Inventor: Eugene Schildmeier, Anderson, IN (US)

( * ) Notice: Subject to any disclaimer, the term of this patent is extended or adjusted under 35 U.S.C. 154(b) by 229 days.

(21) Appl. No.: 13/085,068

(22) Filed: Apr. 12, 2011

(65) Prior Publication Data

US 2011/0247462 A1 Oct. 13, 2011

Related U.S. Application Data

(60) Provisional application No. 61/323,821, filed on Apr. 13, 2010.

(51) Int. Cl.
*H01K 3/32* (2006.01)

(52) U.S. Cl.
USPC ..... 81/53.11; 81/53.1; 81/53.12

(58) Field of Classification Search
USPC ..... 81/53.1, 53.11, 53.12
See application file for complete search history.

(56) References Cited

U.S. PATENT DOCUMENTS

| | | | | |
|---|---|---|---|---|
| 840,102 | A | 1/1907 | Bates | |
| 4,314,723 | A | 2/1982 | Vermillion | |
| 4,719,826 | A | 1/1988 | Du Bois | |
| 5,317,939 | A * | 6/1994 | Marinescu | 81/53.11 |
| 5,809,850 | A * | 9/1998 | Tickner | 81/53.11 |
| 6,003,821 | A * | 12/1999 | Fabian et al. | 248/104 |
| 6,223,628 | B1 | 5/2001 | Barron | |
| 6,257,095 | B1 * | 7/2001 | Yukness | 81/53.11 |
| 6,553,872 | B1 | 4/2003 | Tse et al. | |
| 6,598,838 | B2 * | 7/2003 | Suh | 248/104 |
| 2003/0222466 | A1 * | 12/2003 | Schulte | 294/19.1 |

* cited by examiner

*Primary Examiner* — Lee D Wilson
*Assistant Examiner* — Shantese McDonald
(74) *Attorney, Agent, or Firm* — John Ritchison; Ritchison Law Offices, PC

(57) ABSTRACT

An apparatus for handling spiral-type fluorescent light bulbs particularly for removing and installing different size spiral fluorescent light bulbs in a light fixture. The device is comprised of a main body made of a durable and flexible material and having a front and a rear surface, side surfaces and features; a means to secure a main body to a pole adapter; and a pole adapter for the securement of the main body to an extension pole or similar device. An alternative embodiment anticipates reinforcement strips internal to the main body to provide additional strength, especially when the device is twisted and in torsion. Another alternative embodiment provides an external containment means to enable various modes of containment features and permit different marketing themes.

18 Claims, 6 Drawing Sheets

Line drawing with spines and without

SPECIAL FLUORESCENT BULB HOLDING DEVICE

This application claims the benefit of Provisional Patent Application Ser. No. 61/323,821 filed Apr. 13, 2010 by Eugene Schildmeier and entitled "Special Fluorescent Bulb Holding Device".

CROSS-REFERENCE TO RELATED APPLICATIONS

Not Applicable

FIELD OF INVENTION

This invention relates to an apparatus for handling spiral-type fluorescent light bulbs and more particularly, but not by way of limitation, to an apparatus for removing and installing different size spiral fluorescent light bulbs in a light fixture. Particularly this new device is related to devices and methods to hold a fluorescent bulb in a safe and efficient manner when work is being temporarily performed. This Special Fluorescent Bulb Holding Device is a new combination of existing materials configured with unique features that provide an effective, practical and economical way to provide a Special Fluorescent Bulb Holding Device. The preferred and alternative embodiments are described below.

FEDERALLY SPONSORED RESEARCH

None.

SEQUENCE LISTING OR PROGRAM

None.

BACKGROUND

Field of Invention and Prior Art

A. Introduction of the Problems Addressed

Ever since the advent of glass electric light bulbs combined with high ceilings, the need for ways to handle and change burnt-out bulbs has existed. Over the years, a series of simple grasping devices emerged. However, the latest changes of the standard light bulbs to the energy efficient fluorescent replacements have created a problem. The new bulbs have an irregular shape of spiral tubes and are more delicate than the incandescent predecessor. As a result, a simple, cost efficient means to change the newly configured fluorescent bulbs is needed. The Special Fluorescent Bulb Holding Device meets and exceeds this need, providing a simple, safe bulb holder that engaged the fluorescent bulb from the center and provides a secure resistance/friction hold to enable the bulbs to be changed. This new device is easily combined with existing pole technology so that residential and commercial maintenance of the fluorescent bulbs is possible.

B. Prior Art

In prior art, disclosures have been made, many including complex devices and systems to hold an incandescent bulb. These are not only more costly to manufacture but lack the effectiveness to hold the newly configured fluorescent bulbs.

The prior art begins with a 1907 utility patent U.S. Pat. No. 840,102 issued to Bates and entitled "a means for cleaning or manipulating electric light bulbs". It lacks a functional means to hold the newly designed fluorescent bulbs as described by Schildmeier herein. The Bates means neither anticipates the new art, is obvious, nor is equivalent in function. A collapsible cup-like device is shown by another device shows a utility device called an "Apparatus for removing and installing a light bulb in a light fixture". It was issued in 1982 to Vermillion U.S. Pat. No. 4,314,723. It teaches an apparatus for removing and installing a light bulb in a light fixture. The apparatus is adapted for receipt around different size light bulbs and removing and installing the light bulb without having to handle the light bulb by hand. It is more complex and does not anticipate the Schildmeier device features or and its functions.

A utility device called a "light bulb extractor" was issued in 1988 to Du Bois as a utility patent U.S. Pat. No. 4,719,826. It teaches a steel U-shaped pair of gripping arms that are formed from steel having the proper size and shape to fit over the end of a lamp bulb. The tips of the gripper arms are formed to fit the end of the bulb. A chain is attached between the arms with a second chain attached to its center. Pulling the second chain will close the gripping arms. A slot is provided to secure the second chain to hold the arms at any desired span. This has the shortcomings of the tips being set for an external grip and the fluorescent bulbs are too delicate to permit the grip. The internally engaged Special Fluorescent Bulb Holding Device is superior in the holding quality to avoid bulb damage.

A light bulb remover for removing and replacing light bulbs of various sizes is shown in U.S. Pat. No. 6,223,628 issued to Barron in 2001. The light bulb remover includes a pole portion and a claw portion. The device is removably securable to the pole. A plurality of elongated finger portions that extend upwardly. The device also is hingedly coupled and has a biasing means to allow all the fingers to come together. It is a complex, multi fingered device with several moving parts. It lacks the design of the simple configuration shown and taught herein by Schildmeier.

Finally, an "overhead light bulb changer with safety catch canopy" is taught in U.S. Pat. No. 6,553,872 issued in 2003 to Tse et al. This is a device for screwing in and out light bulbs located at elevated positions from floor level comprising a pole or telescoping tubes which interconnect and have at one end a suction attachment or clamping attachment to affix to the electrical lamp and thereby screw it in or out, with a canopy set on the pole or telescoping tube which can catch the light bulb in the event the suction or clamping attachment releases the light bulb. The whole device has more parts and is complex when compared to the Schildmeier invention.

None of the prior art devices show the simple and functional configuration as the new Special cooking underwater device for Purifying Meats and other Edible items. The particular combinations of materials and features are unique and novel. They are not anticipated by prior art. Likewise unique is the use of the special containment and support device for a food processing compared to prior art devices.

As far as known, there is no other Special Fluorescent Bulb Holding Device or related devices at the present time which fully provide these improvements and functional characteristics as the present Special Fluorescent Bulb Holding Device. It is believed that this device is made with fewer parts with improved configurations and physical features to provide more functionality when compared to other currently utilized bulb changing devices or auxiliary changing aids.

The particular combinations of materials and features are unique and novel and are not anticipated by prior art. Likewise, use of a Special Fluorescent Bulb Holding Device provides significant benefits compared to prior art devices.

SUMMARY OF THE INVENTION

A Special Fluorescent Bulb Holding Device has been developed and designed to provide a unique combination that is specifically related to devices and methods to provide an improved device for changing spiral type fluorescent bulbs and the like. The Special Fluorescent Bulb Holding Device may be used to easily and safely hold a spiral fluorescent bulb while removing and replacing the fluorescent bulb from an elevated light fixture. The benefits are delineated below.

The preferred embodiment of the Special Fluorescent Bulb Holding Device is comprised of a main body made of a durable and flexible material and having a front and a rear surface, side surfaces and features; a means to secure a main body to a pole adapter; and a pole adapter for the securement of the main body to an extension pole or similar device. An alternative embodiment anticipates reinforcement strips internal to the main body to provide additional strength, especially when the device is twisted and in torsion. Another alternative embodiment provides an external containment means to enable various modes of containment features and permit different marketing themes.

OBJECTS AND ADVANTAGES

There are several objects and advantages of the Special Fluorescent Bulb Holding Device. There are currently no known Special Fluorescent Bulb Holding Device or other bulb holding devices that are effective at providing the objects of this invention.

The following TABLE A summarizes various advantages and objects of the Special Fluorescent Bulb Holding Device. This list is exemplary and not limiting to the many advantages offered by this new device.

TABLE A

Various Benefits, Advantages and Objects
This device:

| ITEM | BENEFIT |
|---|---|
| 1. | Reduces risk of breakage through soft, sponge like holding element as a soft holding mandrel from inside the fluorescent bulb to provide an interference, friction fit. |
| 2. | Reduces risk of impact through no metal parts around bulb. |
| 3. | May be used with existing extension poles |
| 4. | Is light and easy to maneuver. |
| 5. | May be manufactured in an inexpensive manner with existing processes and equipment. |
| 6. | Has no moving parts. |
| 7. | May be both installed and removed quickly. |
| 8. | May be stored in small area. |
| 9. | Is adaptable to various sized bulbs. |
| 10. | Is easy to package and transport |
| 11. | Can be sold and distributed retail, wholesale, or E-commerce internet sales from a website |
| 12. | May have various outer configurations to adapt to different marketing themes such as animals and specialty objects. |

Noteworthy is that other advantages and additional features of the present Special Fluorescent Bulb Holding Device will be more apparent from the accompanying drawings and from the full description of the device. For one skilled in the art of bulb handling and changing devices and accessories, it is readily understood that the features shown in the examples with this device is readily adapted for improvement to other types of mechanisms and devices for use as a bulb changing device or accessory.

DESCRIPTION OF THE DRAWINGS

Figures

The accompanying drawings, which are incorporated in and constitute a part of this specification, illustrate a preferred and alternative embodiments for the Special Fluorescent Bulb Holding Device. The drawings together with the summary description given above and a detailed description given below serve to explain the principles of the Special Fluorescent Bulb Holding Device. It is understood, however, that the device is not limited to only the precise arrangements and instrumentalities shown.

DESCRIPTION OF THE DRAWINGS

Reference Numerals

The following list refers to the drawings:

TABLE B

Reference numbers

| Ref # | Description |
|---|---|
| 31 | General Special Fluorescent Bulb Holding Device |
| 31A | Prototype of a Special Fluorescent Bulb Holding Device |
| 32 | Main body of the device (one-piece) |
| 32A | Wide section of the main body 32 |
| 33 | Transition to extension |
| 34 | Extension structure (fingers) of the device or mandrel like structure |
| 35 | Aperture (space) between extensions |
| 36 | Junction at base to means |
| 37 | Means to connect main body to pole adapter |
| 38 | Pole adapter |
| 39 | Support (strengthening) splines |
| 40 | Extension pole |
| 41 | Fluorescent Spiral Bulb |
| 50 | Person using device |
| 51 | Changing the Fluorescent Bulb 41 with the special Device 31 |
| 52 | Light receptacle |
| 61A, B | External containment means such as a stuffed animal or equal |
| 71 | External containment means such as a novelty item or equal |
| 81 | External containment means such as a can or equal |

DETAILED DESCRIPTION OF PREFERRED EMBODIMENT

The present invention presented is a Special Fluorescent Bulb Holding Device 31. Particularly the preferred embodiment of the Special Fluorescent Bulb Holding Device 31 is related to devices and methods that provide a unique combination of materials with features which have been specifically configured to provide a device and method to hold a fluorescent bulb in a safe and efficient manner when work is being temporarily performed. The preferred embodiment of the Special Fluorescent Bulb Holding Device is comprised of a main body made of a durable and flexible material and having a front and a rear surface, side surfaces and features; a means to secure a main body to a pole adapter; and a pole adapter for the securement of the main body to an extension pole or similar device. An alternative embodiment anticipates reinforcement strips internal to the main body to provide additional strength, especially when the device is twisted and in torsion. Another alternative embodiment provides an external containment means to enable various modes of containment features and permit different marketing themes.

Figure 3B:
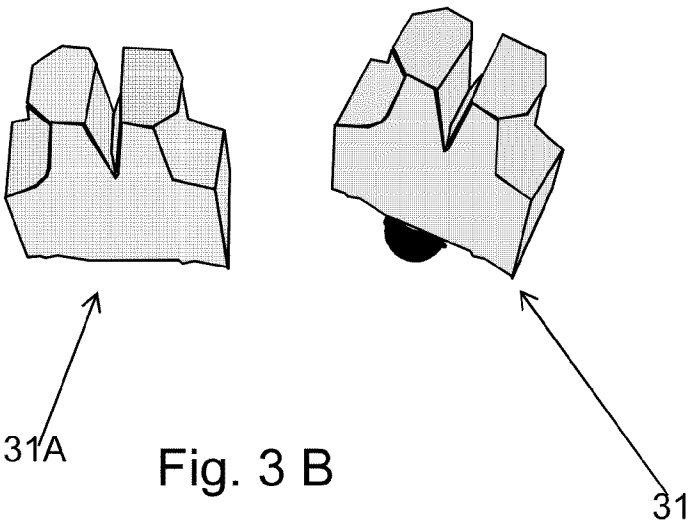
FIGS. 3 A and B are prototypes with and without the connection means.
Figure 3A:
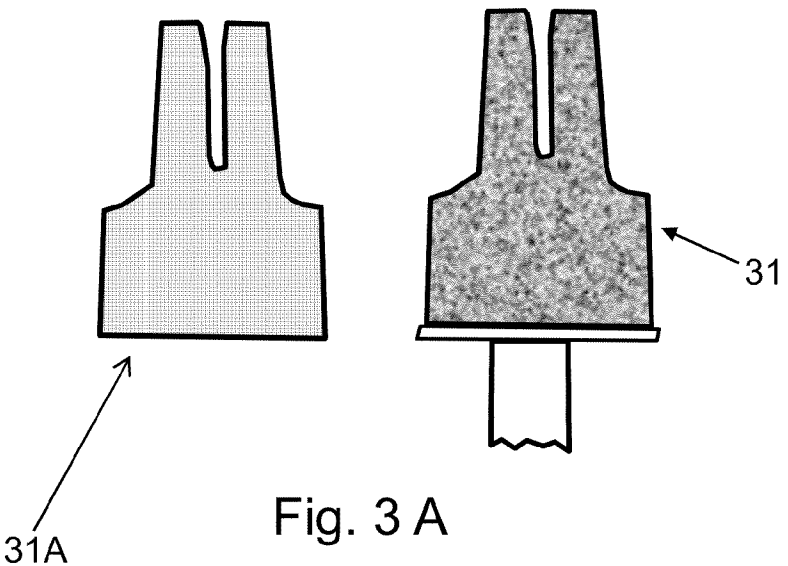
Figure 4:
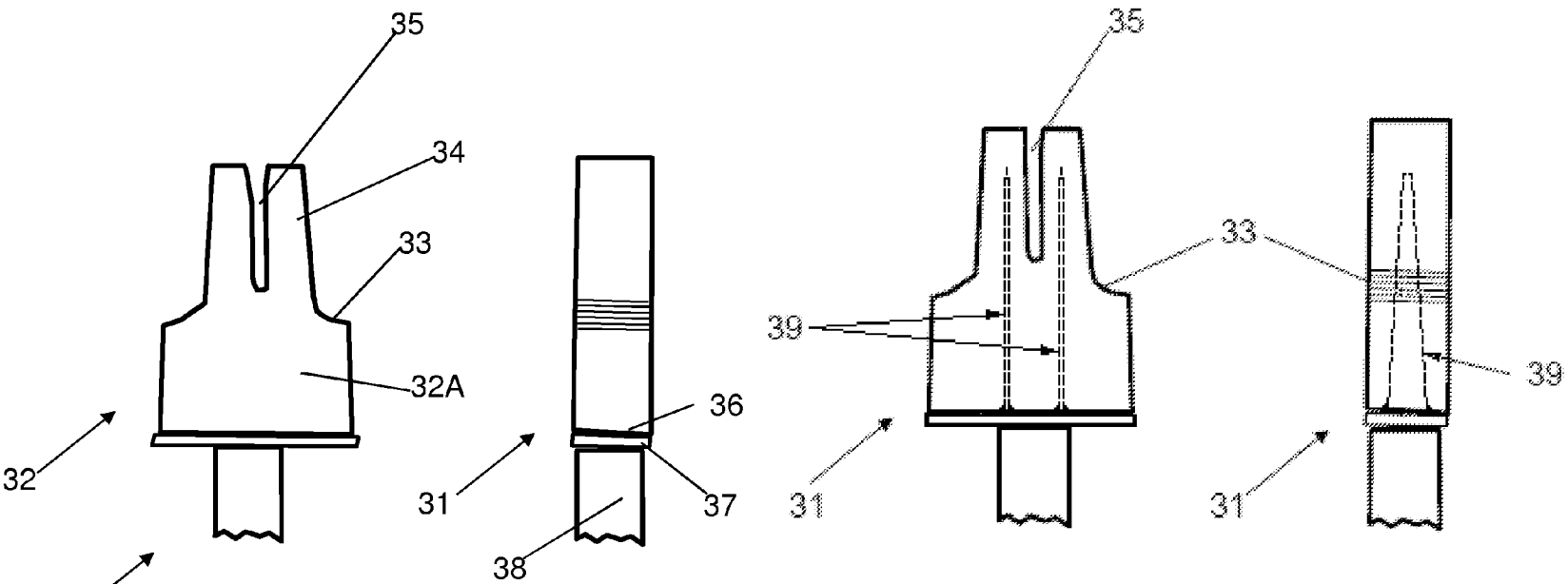
FIGS. 4 A through 4 D show sketches of the device with an internal support spline for added strength.
Figure 5B:
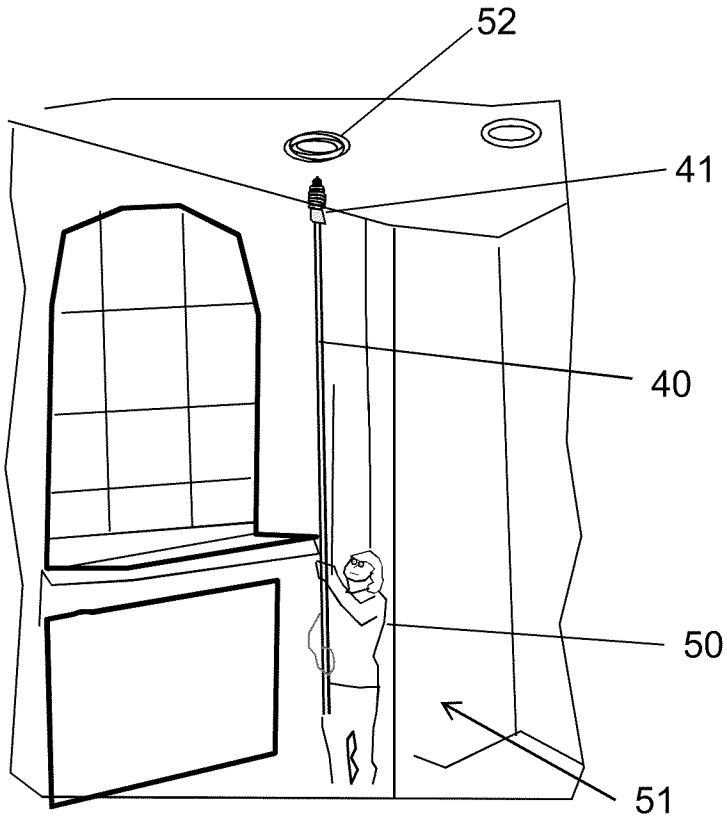
FIGS. 5 A and 5 B are sketches of the device in operation.
Figure 5A:
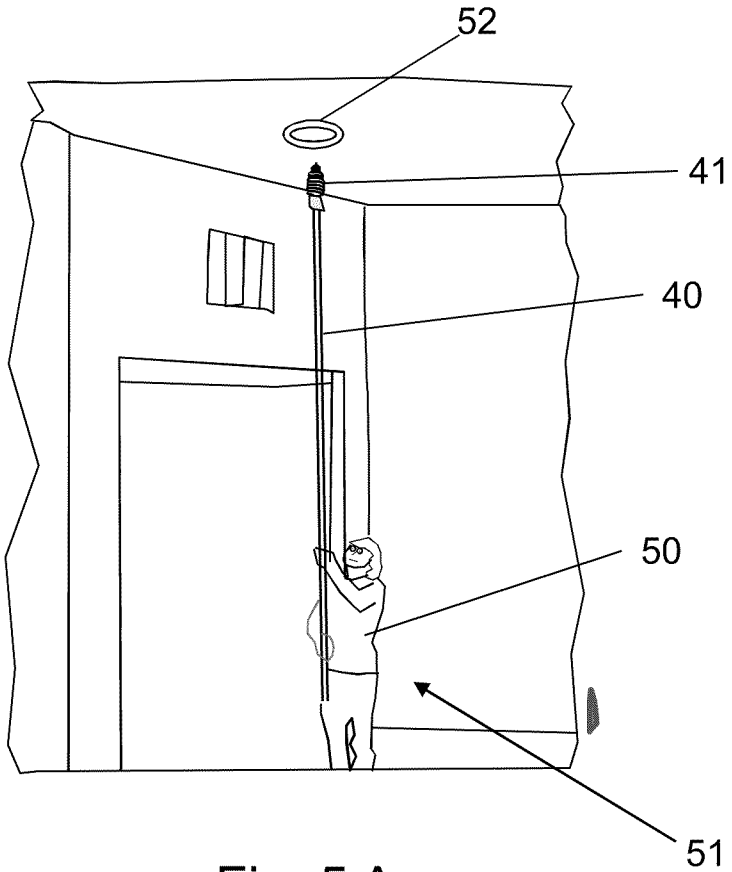

There is shown in FIG. 1 through FIG. 6 a complete detail and operative embodiment of the Special Fluorescent Bulb Holding Device 31. In the drawings and illustrations, one notes well that the FIG. 1 through FIG. 4 and FIG. 6 details the special configuration and FIG. 5 show the operative use of this invention. The operation of the Special Fluorescent Bulb Holding Device 31 is discussed below in the Operations section.

The advantages for the Special Fluorescent Bulb Holding Device 31 are listed above in the introduction. Succinctly the benefits are the device:

- Reduces risk of breakage through soft, sponge like holding element as a soft holding mandrel from inside the fluorescent bulb to provide an interference, friction fit.
- Reduces risk of impact through no metal parts around bulb.
- May be used with existing extension poles
- Is light and easy to maneuver.
- May be manufactured in an inexpensive manner with existing processes and equipment.
- Has no moving parts.
- May be both installed and removed quickly.
- May be stored in small area.
- Is adaptable to various sized bulbs.
- Is easy to package and transport
- Can be sold and distributed retail, wholesale, or E-commerce internet sales from a website
- May have various outer configurations to adapt to different marketing themes such as animals and specialty objects.

The preferred embodiment of the Special Fluorescent Bulb Holding Device is comprised of a main body made of a durable and flexible material and having a front and a rear surface, side surfaces and features; a means to secure a main body to a pole adapter; and a pole adapter for the securement of the main body to an extension pole or similar device. An alternative embodiment anticipates reinforcement strips internal to the main body to provide additional strength, especially when the device is twisted and in torsion. Another alternative embodiment provides an external containment means to enable various modes of containment features and permit different marketing themes.

The accompanying drawings, which are incorporated in and constitute a part of this specification, illustrate a preferred embodiment of the Special Fluorescent Bulb Holding Device 31. The drawings together with the summary description given above and a detailed description given below serve to explain the principles of the Special Fluorescent Bulb Holding Device 31. It is understood, however, that the Special Fluorescent Bulb Holding Device 31 is not limited to only the precise arrangements and instrumentalities shown.

Figure 1A:
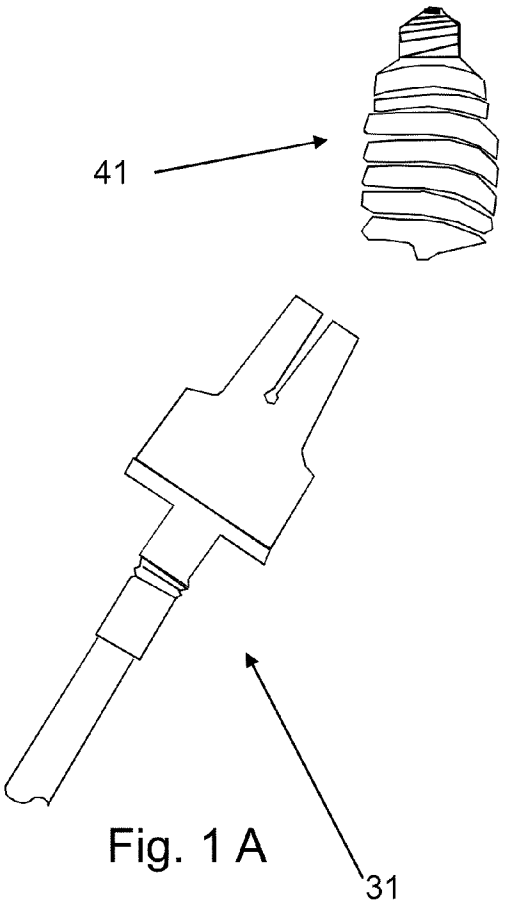
FIGS. 1 A through 1 C are the general views of the Special Fluorescent Bulb Holding Device, the device with a bulb and a person using the device to change or replace a bulb.
Figure 1B:
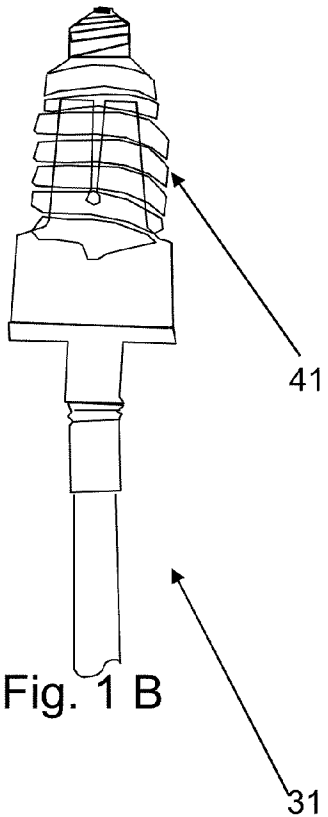
Figure 1C:
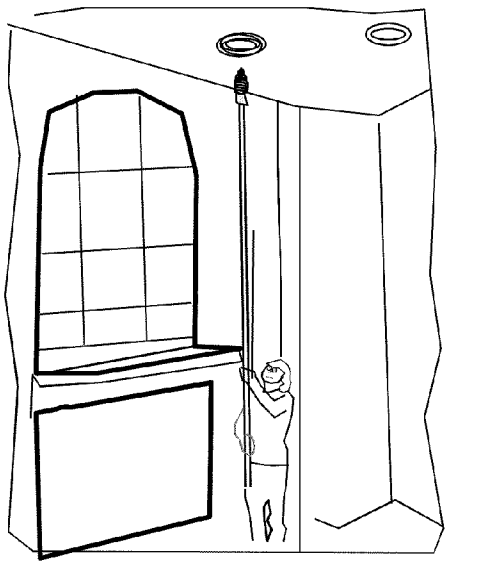

FIGS. 1 A through 1 C are the general views of the Special Fluorescent Bulb Holding Device, the device with a bulb, and a person using the device to change or replace a bulb. The details and features are described below.

Figure 2:
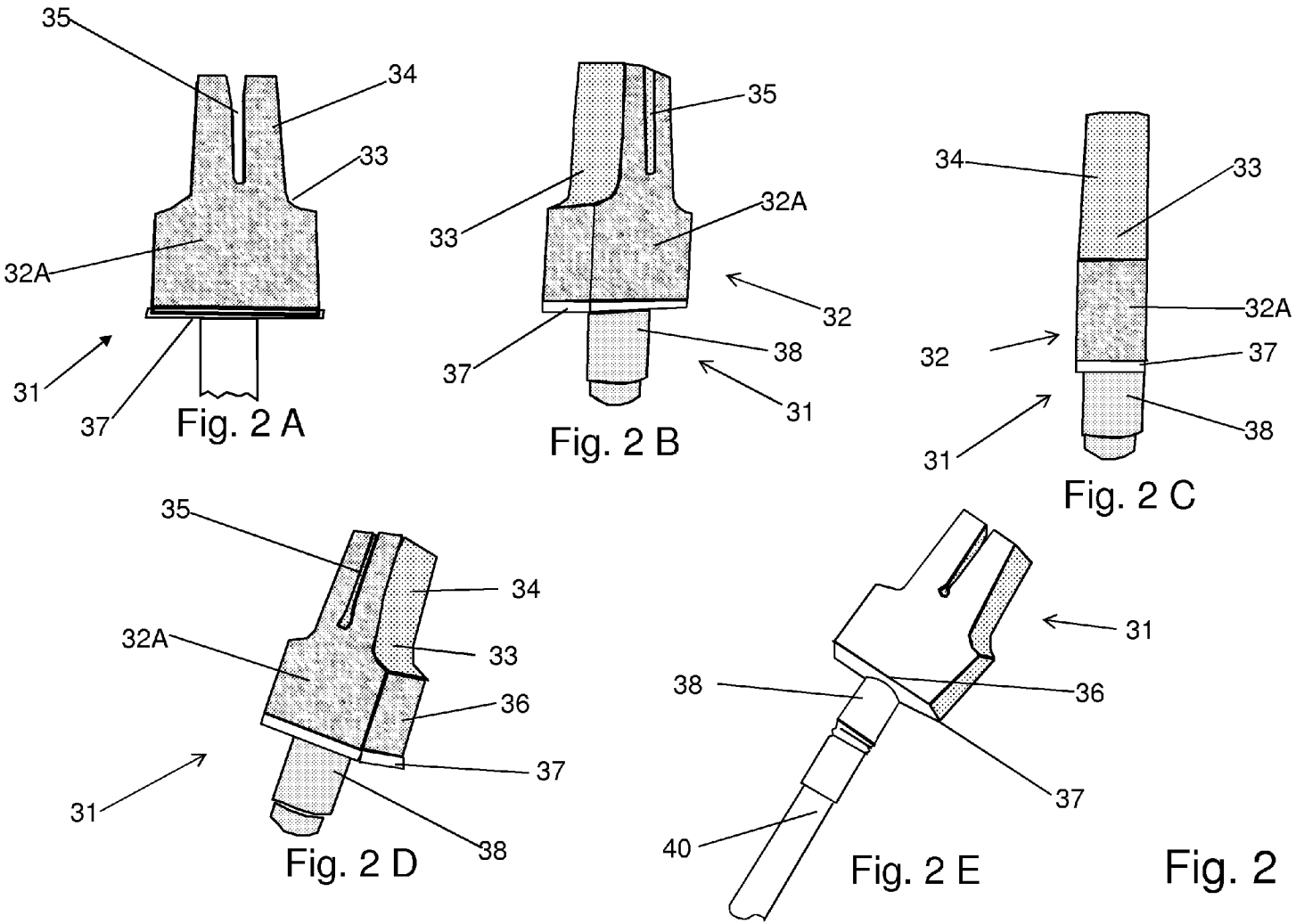
FIGS. 2 A through 2 E are pictures of the device with features and components identified.

FIGS. 2 A through 2 E are sketches of the device with features and components identified. FIG. 2 A shows the device 31 with the one-piece main body 32, a wide section 32A, the featured transition area 33 and the extension structure of one or more (fingers) 34 or mandrel like structure which create an aperture (space) 35. The bulb 41 is held by the fingers 34 wedging internally to the bulb 41 and squeezing fingers 34 together, narrowing the aperture 35. Also shown is the means 37 to connect and secure the device 31 to the pole adapter 38. FIG. 2 B shows an isometric or angle view of the same components and features as well as the pole adapter 38. FIG. 2 C is a side view of the device 31 and features. FIG. 2 D and FIG. 2 E show the device 31 as well as the junction point 36 where the one-piece body 32 wide section 32A meets the means to connect 37. The junction point 36 provides a surface where the body 32 may be secured to the means 37. This securement method anticipates an adhesive, a heat process or a mechanical fastening means such as splines, barbs and the like. The material anticipated for the Special Fluorescent Bulb Holding Device 31 is a non-toxic closed cell foam, a vinyl plastic, a composite material, or the like. One skilled in material selection well appreciates the plethora of materials—both natural and man-made composites—that may fully support the scope and spirit of this invention. Other possible materials could be, for example a polyurethane or a plastic with a relative soft durometer for flexibility but resistive to tears and cutting; vinyl covered cardboard or recycled cellulose materials; or the like.

FIGS. 3 A and B are prototype sketches with 31 and without 31A the connection means 37. View FIG. 3 A is a front view while FIG. 3 B is a top view at a slight angle.

FIGS. 4 A through 4 D show sketches of the device with an internal support splines 39 for added strength. Here the splines 39 are made to be internal to the one-piece main body 32 and extensions 34 to provide support and reinforcement to the overall device 31. The splines 39 add torsional resistance to help prevent tears and overstress to the main body 32 and extensions 34 especially during the turning or torsional operation.

FIGS. 5 A and 5 B are operational sketches and they are explained below.

Figures 6B, 6C:
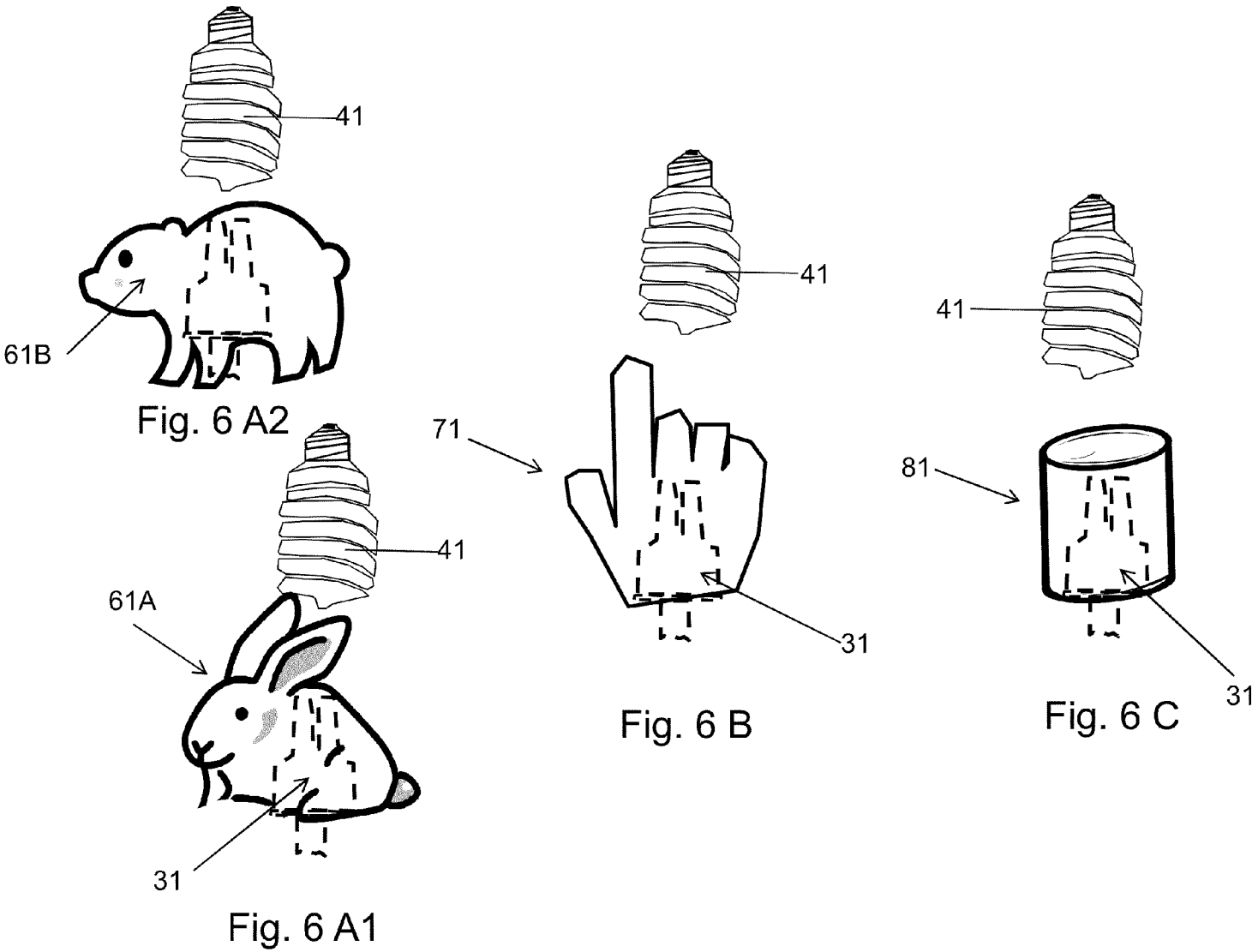
FIGS. 6 A through 6 C show sketches of the device with an external containment feature for aesthetics and marketing.

FIGS. 6 A through 6 C show sketches of the device with an external containment features for aesthetics and marketing enhancements. These exterior devices are for illustration and example and not as a limitation to the scope of this invention. FIGS. 6 A1 and 6 A2 show an animal such as a bear 61B or rabbit 61A—to exemplify a soft handling with a stuffed animal. FIG. 6 B shows a novelty hand 71 as a holding device. FIG. 6 C shows a containment item 81—here a "band or plastic can". All these depictions show various containments such as animals and specialty objects which provide some surface theme to the overall Special Fluorescent Bulb Holding Device 31.

All of the details mentioned here are exemplary and not limiting. Other components specific to describing a Special Fluorescent Bulb Holding Device 31 may be added as a person having ordinary skill in the field of light bulb changing devices and accessorial apparatuses well appreciates.

Operation of the Preferred Embodiment

The preferred embodiment for the Special Fluorescent Bulb Holding Device 31 has been described in the above paragraphs. The manner of how the device operates is described below. One skilled in the art of light bulb changing devices and accessories will note that the description above and the operation described here must be taken together to fully illustrate the concept of the Special Fluorescent Bulb Holding Device 31.

The preferred embodiment of the Special Fluorescent Bulb Holding Device 31 is comprised of a main body made of a durable and flexible material and having a front and a rear surface, side surfaces and features; a means to secure a main body to a pole adapter; and a pole adapter for the securement of the main body to an extension pole or similar device. An alternative embodiment anticipates reinforcement strips internal to the main body to provide additional strength, especially when the device is twisted and in torsion. Another alternative embodiment provides an external containment means to enable various modes of containment features and permit different marketing themes.

FIGS. 5 A and 5 B are sketches of the device 31 in the operation 51 of changing a bulb 41. Here the operator 50 extends the device 31 by means of the pole 40 to extend the device upward and remove the old bulb 41 from the light receptacle 52. Next the operator 50 lowers the pole 40 and device 31 and once at essentially reachable level, the operator 50 removes the old bulb 41. Then the operator 50 takes time to place a fluorescent bulb 41 onto the device 31. The bulb 41 is held by the mandrel 34 from inside the fluorescent bulb to provide an interference, friction fit. The bulb 41 is held by the fingers 34 wedging internally to the bulb 41 and squeezing fingers 34 together, narrowing the aperture 35. There are no moving devices whatsoever. The operator 50 next extends the device 31 by means of the pole 40 to move the device and new bulb 41 upward and place the bulb 41 into the light receptacle 52 or receiving receptacle.

With the above description it is to be understood that the Special Fluorescent Bulb Holding Device 31 is not to be limited to only the disclosed embodiment. The features of the Special Fluorescent Bulb Holding Device 31 are intended to cover various modifications and equivalent arrangements included within the spirit and scope of the description.

What is claimed is:

1. A spiral fluorescent bulb holding device comprised of (a) a one-piece main body made of a durable and flexible material and having a front surface, a rear surface, a top surface, a bottom surface, and side surfaces located between the front, rear, top and bottom surfaces, a wide section located at the bottom surface, transition surfaces located from both sides of the wide surface to a mandrel finger, said mandrel finger comprising an aperture located in the middle of the mandrel finger, which produces two halves of the mandrel finger;

(b) a means for securing the one-piece main body to a pole adapter; and (c) a pole adapter as a means for securing the one-piece main body to an extension pole or similar device wherein the spiral fluorescent bulb holding device may be used to create an interference, friction fit from the inside of the spiral fluorescent bulb to remove an old, used fluorescent spiral bulb and then replace the spiral bulb with a new spiral fluorescent bulb.

2. The device according to claim 1 wherein the durable and flexible material is a non-toxic closed cell foam.

3. The device according to claim 1 wherein the durable and flexible material is a vinyl plastic.

4. The device according to claim 1 wherein the durable and flexible material is a composite material.

5. The device according to claim 1 wherein the durable and flexible material is a polyurethane.

6. The device according to claim 1 wherein the durable and flexible material is a plastic with a soft durometer material.

7. The device according to claim 1 wherein the durable and flexible material is a vinyl covered cellulose material.

8. The device according to claim 1 further comprising a means for externally containing the device.

9. The device according to claim 8 wherein the means for externally containing the device is an animal toy.

10. The device according to claim 8 wherein the means for externally containing the device is a canister.

11. The device according to claim 8 wherein the means for externally containing the device is a novelty device.

12. The device according to claim 1 wherein the means for securing the one-piece main body to a pole adapter is a mechanical means.

13. The device according to claim 12 wherein the mechanical means are splines.

14. The device according to claim 12 wherein the mechanical means are barbs.

15. The device according to claim 12 wherein the mechanical means are reinforcement strips internal to the one-piece main body.

16. The device according to claim 1 wherein the means for securing the one-piece main body to a pole adapter is an adhesive.

17. The device according to claim 1 wherein the means for securing the one-piece main body to a pole adapter an heat process.

18. A spiral fluorescent bulb holding device comprised of (a) a one-piece main body made of a durable and flexible material and having a front surface, a rear surface, a top surface, a bottom surface, and side surfaces located between the front, rear, top and bottom surfaces, a wide section located at the bottom surface, transition surfaces located from both sides of the wide surface to a mandrel finger, said mandrel finger comprising an aperture located in the middle of the mandrel finger, which produces two halves of the mandrel finger;

(b) a means for securing the one-piece main body to a pole adapter the means comprised of internal reinforcement strips; and (c) a pole adapter as a means for securing the one-piece main body to an extension pole or similar device wherein the spiral fluorescent bulb holding device may be used to create an interference, friction fit from the inside of the spiral fluorescent bulb to remove an old, used fluorescent spiral bulb and then replace the spiral bulb with a new spiral fluorescent bulb.

* * * * *